United States Patent [19]

Ravipati et al.

[11] Patent Number: 5,014,468

[45] Date of Patent: May 14, 1991

[54] PATTERNED COATED ABRASIVE FOR FINE SURFACE FINISHING

[75] Inventors: Sitaramaiah Ravipati, Latham; Eugene Zador; Wesley R. Kaczmarek, both of Ballston Lake, N.Y.; Ernest A. Coleman, Stamford, Conn.; David Rostoker, Sturbridge, Mass.

[73] Assignee: Norton Company, Worcester, Mass.

[21] Appl. No.: 347,663

[22] Filed: May 5, 1989

[51] Int. Cl.[5] ..... B24B 1/00

[52] U.S. Cl. ..... 51/295; 51/293; 51/298; 51/308; 51/309

[58] Field of Search ..... 51/293, 295, 298, 308, 51/309

[56] References Cited

U.S. PATENT DOCUMENTS

| | | | |
|---|---|---|---|
| 3,605,349 | 9/1971 | Anthon | 51/402 |
| 3,991,527 | 11/1976 | Waran | 51/402 |
| 4,047,903 | 9/1977 | Hesse et al. | 51/295 |
| 4,457,766 | 7/1984 | Caul | 51/298 |
| 4,644,703 | 2/1987 | Kaczmarek et al. | 51/298 |
| 4,773,920 | 9/1988 | Chasman et al. | 51/295 |

*Primary Examiner*—William R. Dixon, Jr.
*Assistant Examiner*—Willie J. Thompson
*Attorney, Agent, or Firm*—Arthur A. Losielle

[57] ABSTRACT

Coated abrasive material for fine finishing applications including second fining ophthalmic application, having patterned surface coating of abrasive grains dispersed in radiation-cured adhesive binder. The patterned surface coating is defined by a plurality of formations of such abrasive/binder each having an inner bottom edge defining an area devoid of coated abrasive, a top edge defining a somewhat larger area devoid of coated abrasive and an inner wall connecting the top and bottom edges.

45 Claims, 4 Drawing Sheets

PATTERNED COATED ABRASIVE FOR FINE SURFACE FINISHING

BACKGROUND OF THE INVENTION (1) Field of the Invention

This invention relates to specific, radiation-cured, coated abrasive products having novel patterned surface coatings useful in the ophthalmic, crankshaft and other fine finishing operations such as the sanding of automotive parts requiring a combination of controllable fine surface finishing and high cut rate.

(1) Description of the Prior Art

The so-called conventional manufacture of coated abrasive material requires, in general, the coating of a "maker" coat, i.e., a solvent or water-based adhesive composition, onto a backing member, followed by the application of grain thereto by electrostatic deposition. The curing of the maker coat, i.e., the adhesive or binder layer, to adhere the grain to that layer and the maker coat layer to the backing member is by thermal curing and, generally, requires a relatively long time, e.g., up to several hours in some cases. This is accomplished while passing the coated abrasive material through a loop dryer. While a loop dryer allows for long drying and curing times, the use of such is attendant with certain disadvantages such as the formation of defects where the material is suspended, sagging of the maker coat before it becomes sufficiently hardened and changing of the grain position due to the material being vertically suspended, variations in temperature and the resulting inconsistent cross-linking of the binder comprising the maker coat due to the necessarily slow air circulation.

In addition to the maker coat, a size coat is also generally applied over the abrasive grains, in the manufacture of conventional coated abrasive material, sometimes before the maker coat is completely cured. This coat also necessitates curing and passing of the coated abrasive material through a loop dryer due to the relatively long curing times required. Also, in some cases, the backing member, particularly if of cloth, need be provided with a so-called "back" coat and a pre-size coat, prior to the application of the maker coat. Thus, the conventional manufacture of coated abrasive material requires not only a considerable time for thermal curing of various coatings involved in its manufacture, but also, as earlier pointed out, is accompanied with certain necessary defects resulting from the manner of manufacture involved.

In somewhat more recent times, it has been suggested that a reduction in the manufacturing time for coated abrasive material could be achieved through curing of the various coating materials involved by electron beam radiation. Thus, in U.S. Pat. No. 4,047,903, which issued on Sept. 13, 1977 to Hesse et al. there is disclosed coated abrasive material which is manufactured by coating a backing member with at least one base layer of a binder resin hardenable by irradiation, at least one intermediate layer of abrasive grains, and at least one top layer of binding resin hardenable by irradiation. The binder resin comprises, in general, the reaction product of a polycarboxylic acid with an esterified epoxy resin, prepared by the reaction of an epoxy resin with a member selected from the group consisting of acrylic acid and methacrylic acid and the reaction product of such an epoxy resin first reacted with diketenes and then reacted with a chelate forming compound. Although the binder system is different than found in the conventional coated abrasive materials, the construction is much the same. Neither is there any suggestion by Hesse et al that patterned surface coatings can be obtained.

Subsequently, in U.S. Pat. No. 4,457,766, which issued July 3, 1984, on an application filed Oct. 8, 1980, and which is now assigned to Norton Company, the Assignee of the instant application, there was disclosed another binder system for use in the manufacture of coated abrasive material. Such a binder system comprises, in general, an oligomer, a diluent, fillers and minor amounts of other additives, the various components being selected in each case to give the desired physical properties to the coated abrasive material manufactured. The oligomer selected, as disclosed by the patentee, can be any reactive polymer which gives the desired properties to the backing member and the coated abrasive material. Suitable electron beam curable materials disclosed are urethane-acrylates and epoxy-acrylates. Particularly preferred are the diacrylate esters such as the diacrylate esters of bisphenol-A epoxy resin. Among the diluents disclosed, which are disclosed by the patentee to be utilized to adjust the viscosity of the binder so as to be suitable for the various coating methods to be used, are the vinyl pyrrolidones and the multifunctional and monofunctional acrylates. The compounds that are disclosed to be preferred by the patentee are N-vinyl-2-pyrrolidone (NVP); 1,6 hexanediol diacrylate (HDODA); tetraethylene glycol diacrylate (TTEGDA); and trimethylopropane triacrylate (TMPTA). "Such materials have been found by the patentee to be not only successful when used in adjusting viscosity and controlling flexibility, but also when used in reducing the radiation required for curing." The coated abrasive materials disclosed, nevertheless, are of the conventional type long manufactured except that an electron beam curable binder is used. Thus, a cloth backing member may be provided with a back and face fill of the binder, as conventionally done, and partially cured prior to application of a maker coat, all of which may comprise the same components but in somewhat different formulation. Following application of the maker coat, abrasive grain is applied to the maker coat and the maker coat is then cured by electron beam through the backing member. The size coat of similar formulation as the maker coat is then applied and cured. Patterned surface coatings are not disclosed or even suggested.

In U.S. patent application Ser. No. 474,377, filed in the United States Patent and Trademark Office on Mar. 11, 1983 by Stanley J. Supkis, Jr., Richard A. Romano, and Walter A. Yarbrough, now abandoned, and assigned to Norton Company, the Assignee of this application, there was disclosed coated abrasive material in which the adhesive was cured by exposure to ultraviolet ("UV") light. Prior to the invention disclosed in that application, it appeared to be generally believed that the relatively thick adhesive coatings typically required for coated abrasives, as compared with most decorative surface coatings then being UV light cured, would be very difficult, if not impossible, to cure by UV light, due to the limited depth of penetration of such light. Therefore, most of the workers in the field of coated abrasives are believed to have concentrated on electron beam curing instead, as exemplified by the earlier-mentioned U.S. Pat. No. 4,457,766.

As disclosed in application Ser. No. 474,377, the coated abrasive manufacturing process, in general, involves coating an abrasive grain and adhesive slurry onto a suitable backing member, rather than the conventional technique of applying a maker coat to a backing member, followed by electrocoating abrasive grain, and then application of the size coat. The adhesive grain slurry in U.S. Pat. No. 474,377 comprises, in general, three classes of components, namely, acrylate monomer, photoinitiator, and abrasive grain. Other components, however, may optionally be present. As disclosed by the inventors in that application, it is necessary to utilize substantial amounts of acrylate monomers containing three or more acrylate groups per molecule. Typical commercial products of this type, as disclosed, are trimethylolpropane triacrylate ("TMPTA") and pentaerythritol triacrylate ("PETA"). Nevertheless, if somewhat less brittle cured products are desired, difunctional acrylate monomers, e.g., 1.6-hexanediol diacrylate ("HDODA"), are included in the dispersion as well. The relative amounts of such di- and tri- functional acrylates must be adjusted, along with those of the other components in the slurry, to give proper viscosity for coating as well as acceptable characteristics for the cured film. Optionally, for further adjustments of the rheology of the slurry as coated and the toughness and cutting characteristics of the cured product, higher molecular weight acrylate oligomers are normally used in addition to the acrylate monomers noted above. The preferred oligomers, as disclosed in application Ser. No. 474,377, are the diacrylates of bis-phenol A type epoxy resins and the di- to octo-acrylates of novolak phenolic resins prepared by the condensation of bis-phenol A or other similar di-phenols with formaldehyde. Other optional components disclosed for inclusion in the slurry are organosilanes and organotitanates for improving the bond between the adhesive and abrasive grain. Further, the inventors disclose that organic tertiary amines, the preferred being N-vinyl pyrrolidone ("NVP") can also be added to the formulation to promote adhesion. NVP also, as disclosed, serves as a reactive viscosity-reducing diluent. Actually, it is believed that NVP is a cylic amide rather than an amine derived from a tertiary amine. Nevertheless, as disclosed later on, such components in proper amounts is an essential part of this invention. Although slurry coating is disclosed in this application, contrary to the conventional manufacture of coated abrasive material, the disclosure is not concerned with patterned coatings.

Subsequently there was disclosed in U.S. patent appln. Ser. No. 680,619, filed Dec. 9, 1984, and which is a continuation-in-part of Ser. No. 474,377, that conventional coated abrasive materials can also be manufactured using UV light curable adhesive compositions. Thus, where a conventional coated abrasive material is to be manufactured, the maker coat comprises, in general, an acrylated oligomer, the preferred one being Celrad® 3700, a commercially available diacrylate of epoxy resin of the bisphenol A type and having an average molecular weight per acrylate unit of about 275, a photoinitiator, a thermal initiator, NVP, a viscosity reducer (vinyl acetate) capable of copolymerizing with the acrylated oligomer, and importantly, an amine adduct of an acrylated monomer. The preferred such amine adduct, as disclosed in the application, resulted from the reaction product of 1-octyl amine and TMPTA. The amine adduct provides better adhesion of the maker coat to the coated abrasive backing member. The thermal initiator was added to the maker coat composition whereby curing of the inner part of the adhesive layer was accomplished. The cure initiated by the UV light was found by the inventors to be fully effective only in the outer part of the maker coat layer particularly where the coated abrasive material used abrasive grain which strongly absorbs UV light. Patterned abrasive coatings, however, are not disclosed in this application.

In U.S. patent application Ser. No. 735,029, which was filed on May 17, 1985 by Stanley J. Suphis, Jr., Eugene Zador, Sitaramaiah Ravipate, Richard A. Romano, and Walter A. Yarborough, and which is a continuation-in-part of application Ser. No. 680,619, abovementioned, there is disclosed coated abrasive material of conventional manufacture having harder product cures. With such products, the maker and size coats, as disclosed, each comprises, in addition to various other components, acrylated monomers with four or more acrylate groups per molecule, e.g., dipentaerythritol hydroxy pentacrylate ("DPHPA"). Additionally, the size coat includes a diacrylate of an ester-linked urethane oligomer, e.g. Urethane 783, a commercially available diacrylated polyester urethane oligomer with an average molecular weight of about 5500. The manufacture of such conventional coated abrasive material is accomplished, in general, by application of the maker composition to the backing member, followed by electrocoating of the abrasive grain, after which the maker coat is rapidly cured by exposure to UV light. Next, the size coat is applied, and such is then rapidly cured by further exposure to UV light. Patterned abrasive coatings are not disclosed.

The complete disclosures of applications Ser. Nos. 474,377; 680,619; and 735,029, all above-mentioned, are incorporated herein by reference.

The manufacture of coated abrasive material characterized by various patterned surface coatings of abrasive material has long been disclosed by those in the art. Examplary of prior art patents showing such abrasive coatings are U.S. Pat. Nos. 1,657,784; 2,108,645; 3,605,349; and 3,991,527. In U.S. Pat No. 1,657,784, there is disclosed a coated abrasive material in which various adhesive patterns can be provided on a backing member by means of a roll coater, followed by application of grain to the adhesive coating before it hardens. The desired pattern can be provided in relief on the roll or cylinder used in the adhesive coating. In general, the pattern consists of regular and uniform alterations of abrasive and non-abrading portions with definite channels for the exit from the abrading surface of the dust or particles produced by the abrasion operation.

U.S. Pat. No. 2,108,645 discloses coated abrasive material in which a backing member is provided with an intermittent or discontinuous coating of adhesive. This is accomplished by passing the backing member between two rollers, one of which is smooth and rotates in an adhesive bath. The other roller has a pattern of depressed portions thereon each surrounded by a raised portion. The portion of the backing member which comes opposite the depressions receives adhesive from the smooth roller while that coming under the raised portions receives relatively little. Thus, there results, when abrasive grain is applied, essentially a pattern of islands of abrasive grain surrounded by areas or channels with little or no grain stuck to the backing member.

In U.S. Pat No. 3,605,349, there is disclosed an abrasive finishing article comprising, in general, a backing member, on the surface of which is provided a pattern of islands of abrasive, resulting in channels for circulation of slurry. The abrasive articles can be manufactured by various means one of which involves the use of a roller on the periphery of which are provided raised "islands" or lands, e.g., in diamond shape. The abrasive mixture is first transferred to the roller having the diamond-shaped pattern provided thereon by a smooth roller which rotates in an adhesive bath and which peripherally contacts the patterned roller. The patterned roller then transfers the pattern of abrasive material onto the backing member. Thus, in effect, the diamond-shaped pattern is printed onto the backing member.

The pattern on the coated abrasive material disclosed in U.S. Pat. No. 3,991,527 results from transferring geometrical-shaped patterns of adhesive binder onto a backing member, followed by application of abrasive grain to the adhesive. The adhesive, in one manner of manufacture, is transferred by a smooth roller, rotating in an adhesive bath, to the patterns provided on the patterned roller which, in turn, transfers adhesive in the shape of the pattern to the backing member. As disclosed by the drawings in this patent, the pattern produced comprises what one might call islands of abrasive. And, the islands are surrounded by rightangularly intersecting channels which open onto the outer or peripheral edge of the abrasive discs provided from the abrasive material.

The use of intaglio or rotogravure rolls in various coating processes, including the manufacture of coated abrasive material is well known. Such rolls are provided with various patterns of cells, or wells as they are sometimes called, cut into the surface of the perimeter of the roll, the cell pattern provided and the capacity thereof depending somewhat upon the particular coating application. In general, when such a roll is used in a coating application, it rotates in a pan of the coating material and, as it rotates through the coating material, the cells are loaded up with the coating material much like a bucket conveyer. After the gravure roll rotates out of the pan and before it contacts the backing member onto which the coating material is to be transferred, its surface is wiped with a knife or doctor blade. Thus, only the material contained in the cells is available for coating of the backing member. The amount transferred depends, in general, upon the total theoretical volume of the cells and the particular material that is being coated. As a result, gravure rolls are commonly used when it is desired to apply a controlled amount of coating material to a backing member. Also, such rolls are commonly used when it is desired to provide a particular pattern of coating material onto a substrate. In such a case, cells the shape of the pattern desired in the coating to be provided will be provided in the peripheral surface of the gravure roll. Thus, if it is desired to coat a design having a hexagonal shape onto a substrate, a gravure roll having such a design cut in its surface will be used. Nevertheless, such a roll is not expected to transfer merely an outline of such a design.

Prior to the invention disclosed in this application, others have disclosed the manufacture of coated abrasive material in which a slurry of a radiation curable binder and abrasive grain is applied to a backing member using a gravure roll. Thus, in U.S. Pat. No. 4,644,703, which issued Feb. 24, 1987 to Norton Company, the Assignee of this patent application, there is disclosed coated abrasive material suitable for one step fining of plastic ophthalmic lenses. Such a product is manufactured by coating two distinct layers of an adhesive/abrasive grain slurry onto a backing member, to provide a coarse outer layer and a finer inner layer of abrasive grains. The slurry coatings in that patent are deposited by a gravure roll having a trihelical pattern cut therein which, in turn, imparts a pattern of parallel lines of adhesive/abrasive grain slurry to the backing member and, in turn, to the first deposited coating. Subsequent to application of the first coating, the backing member with the wet slurry thereon passes through a texturing bar assembly whereat the continuity of the deposited coating material, i.e., the lines of wet slurry, is broken up to provide a somewhat discontinuous pattern. Afterwards, the wet slurry coating is subjected to ultraviolet light to cure the adhesive binder and to adhere the abrasive grains to the backing member. After curing of this first coating, a second adhesive/abrasive grain slurry is coated onto the first coated backing member, to provide the outer grain layer in the coated abrasive product. This processing is the same except that a gravure roll having a different helical pattern is used, and there is no texturing of the second applied wet slurry. The abrasive grains are adhered to the backing member, which may be a polyester film, with binders compounded primarily of acrylates in somewhat different formulations for the respective first and second coats. The radiation curable binders, in general, comprise a mix of triacrylated monomers, e.g., trimethylolpropane triacrylate (TMPTA), diacrylated monomers, e.g., hexanediol diacrylate (HDODA) and acrylated oligomers, the preferred being the diacrylates of epoxy resins of the bisphenol-A type. Importantly, also, the patentees disclose including in the adhesive formulations unsaturated organic amines, e.g. N-vinyl pyrrolidone ("NVP"), in a controlled amount to promote adhesion. Although a gravure roll is used in the manufacture of the coated abrasive material disclosed, such roll functions as usual. It deposits a slurry coating of parallel lines as reflected by the pattern cut in the roll surface.

U.S. Pat. No. 4,773,920, which issued to Chasman et al on Sept. 27, 1988, discloses a coated abrasive material suitable for lapping operations including second fining applications for ophthalmic lenses. The coated abrasive material is manufactured by coating a suspension of abrasive grain in a radiation-curable binder onto a backing member such as polyester film. The binder can comprise radiation-curable monomers, as believed disclosed earlier by others above-mentioned, and, optionally, reactive diluents. Of the monomers that are disclosed to be useful, the patentee discloses that such should contain two ethylenically unsaturated moities therein, e.g., hexane diol diacrylate. The preferred radiation curable "monomers", as disclosed, include oligomers selected from urethane acrylates, isocyanurate acrylates, polyester-urethane acrylates and epoxy acrylates. As reactive diluents, the patentees disclose trimethylolpropane triacrylate (TMPTA) and also hexane diol diacrylate. It is preferred, according to the patentees, that a coupling agent, e.g., gamma methacryloxypropyl trimethoxy silane, be included with the monomer to promote adhesion between the abrasive grains and the cured binder. Nevertheless, the patentees disclose that it is also preferred that such silane be coated on the abrasive grain prior to dispersion of the grains in the binder. Rotogravure coating is disclosed to be preferred by the patentees for the reason that the rotogravure coater can impart a uniform pattern of ridges and valleys to the binder composition, which, after the composition is cured, can serve as channels for flow of lubricants and for removal of abraded material. Nevertheless, the patentees fail to disclose any particular gravure roll or the pattern provided therein. Moreover, none of the examples in the patent disclose the use of a gravure roll, even though such is disclosed as preferred. Thus, it is believed that the patentees merely speculate that use of a gravure roll would impart a pattern of ridges and valleys to the binder composition, i.e., a reflection of the design cut in the roll surface, much like the islands of abrasives and channels obtained by those earlier in the prior art.

The expression "ophthalmic lens fining", when it is performed with coated abrasive material on a Coburn-505 fining machine, can refer to a simple "one-step" process or it can denote a more complex "two-step" operation. In one-step fining, a single daisy wheel or film backed fining pad ("Snowflake") is employed before the final slurry-polishing. Such a pad is capable of removing relatively large amounts (0.4–0.6 mm) of excess stock and, at the same time, generate a sufficiently fine, scratch-free surface. In the more common two-step operation, a silicon carbide coated abrasive product (a first fining pad) is used first which removes most of the surplus stock. This is followed then by use of a second-fining pad, a much finer grain, aluminum oxide based, coated abrasive product. This second pad removes little stock (0.03–0.05 mm) but has fine finishing capabilities. Preference for the one-step or the two-step process depends on a number of factors which include the lens type used (glass, CR-39 plastic and polycarbonate are the three most common lens types), the lense curvature (diopter), shape (cylindrical and spherical), and lens size. One-step lens fining is most common with plastic lenses of relatively low diopter and of medium (e.g. 65 mm) size.

In either case, the main objective of lens fining is to prepare the lens for the final or slurry polishing step which is usually performed with slurries of various small particle size aluminum oxide (0.5–1.0 micron range). As a consequence of such low particle size, the slurries cannot remove deep scratches (Rt values greater than, say, 50–70 microns) from lenses obtained during the fining process. Therefore, there is always a need for products that improve the results of the fining or prefinishing process thus reducing the burden, both time and in fine polishing requirements, placed on the slurry-polishing step.

A description of the fining process and of suitable machinery for accomplishing it are disclosed in U.S. Pat. Nos. 3,732,647 (to Stith) and 4,320,599 (to Hill et al), the complete specifications of which are herein incorporated by reference. Stith discloses in FIG. 2 of the patent, a lapping tool such as envisioned by one aspect of the instant invention. The lapping surface 78 of the tool provided in Stith may be a coated abrasive material consisting of abrasive grains adhered to a flexible backing which, in turn, is supported by the structure disclosed in Stith.

Recently there has become available commercially a second fining pad which is characterized by spaced-apart spherical-shaped aggregates of aluminum oxide abrasive grain (3–4 microns) on a backing member. The abrasive grains are held together in the aggregate and the aggregates to the film backing member by a phenolic binder system. During the fining operation, the aggregates are supposed to break down and the fine abrasive particles are then liberated. These liberated abrasive particles are believed responsible for the fine finish obtained.

Although this most recently introduced second fining pad is characterized by its good cut rate and finishing qualities, its use nevertheless is attendant with certain disadvantages. The abrasive aggregates have to be manufactured in a separate process adding cost and quality control problems to the manufacture of the final product. Moreover, although the aggregates are supposed to break down uniformly during the fining process, yielding a quantity of fine grain particles and, ultimately, a more finely finished lens, uniform aggregate breakdown does not always appear to be accomplished in use. Oftentimes, we have discovered, whole aggregates are torn out of the coating under the prevailing pressure (20 psi) in the lapping tool used, leaving holes in the coating which then can cause uneven finishing. Moreover, the binder system is solvent-based, leading to certain problems, as above-disclosed, in addition to polluting the atmosphere.

SUMMARY OF THE INVENTION

A primary object of the instant invention is to provide coated abrasive material having a unique surface coating pattern of coated abrasive.

A further object is to provide coated abrasive material not attendent with the problems and disadvantages of so-called "conventional" coated abrasive material and with its manufacture.

A still further object of the invention is to provide a coated abrasive product useful in providing high quality finishes in various lapping or fine finishing operations, in particular, ophthalmic applications.

Another object of the invention is to provide a coated abrasive product suitable for second fining ophthalmic and other applications requiring a combination of controllable fine surface finishing and relatively high cut rate.

Still another object of the invention is to provide a coated abrasive product which provides a combination of surface finish and cut that is equivalent to that provided by the now commercially available coated abrasive material having aggregates of abrasive material coated on the surface of its backing member.

A further object is to provide a coated abrasive product having improved adhesion between the abrasive grain and binder.

A still further object is to provide an improved process for the manufacture of coated abrasive material.

An even further object of this invention is to provide a coated abrasive product suitable for second fining ophthalmic applications wherein its use results in improved pre-finish, resulting in less time required in the slurry polishing step and an overall reduction in the total ophthalmic processing time needed heretofor.

An additional object is to provide coated abrasive products suitable for use in ophthalmic applications resulting in a fewer number of rejects than heretofor.

Quite advantageously, the coated abrasive material according to this invention offers economies in manufacture through the savings of using less coated abrasive grain, in that less than the total surface area of the backing member is coated.

A further advantage is that the coated abrasive material of this invention is manufactured from solventless, non-polluting dispersions which can be cured rapidly within a matter of seconds by ultraviolet light.

The objects and advantages offered by this invention are provided in coated abrasive material comprising:

(a). a backing member having a top and bottom surface; and (b). an abrasive coating adhered to the top surface of said backing member, said abrasive coating comprising a cured radiation curable binder and abrasive grains dispersed therein and being characterized by a relatively uniform three-dimensional pattern defined by a plurality of coated abrasive formations each of which is contiguous to other of said coated abrasive formations, each said abrasive formation being defined by a bottom inner edge adhered to said top surface and defining an area on the backing member devoid of the said abrasive coating and a top edge defining a somewhat larger area devoid of said abrasive coating, and an inner side wall of the said abrasive coating connecting the said top and bottom edges of the said abrasive coating formation.

BRIEF DESCRIPTION OF THE DRAWINGS

The invention will be more clearly understood by reference to the drawing in conjunction with reading of the following specification, in which.

DETAILED DESCRIPTION OF THE INVENTION AND THE PREFERRED EMBODIMENTS THEREOF

Figure 1:
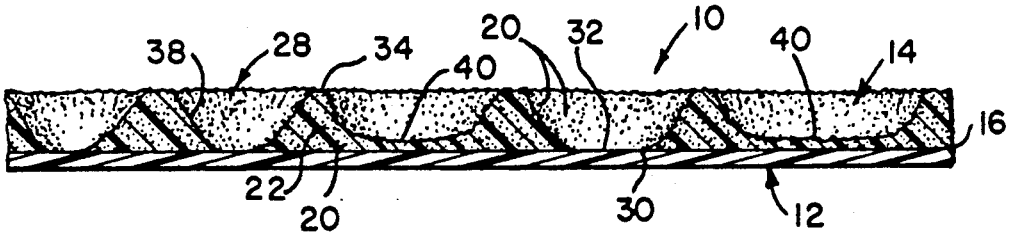
FIG. 1 is a view in cross-section of coated abrasive material in accordance with the invention.
Figure 7:
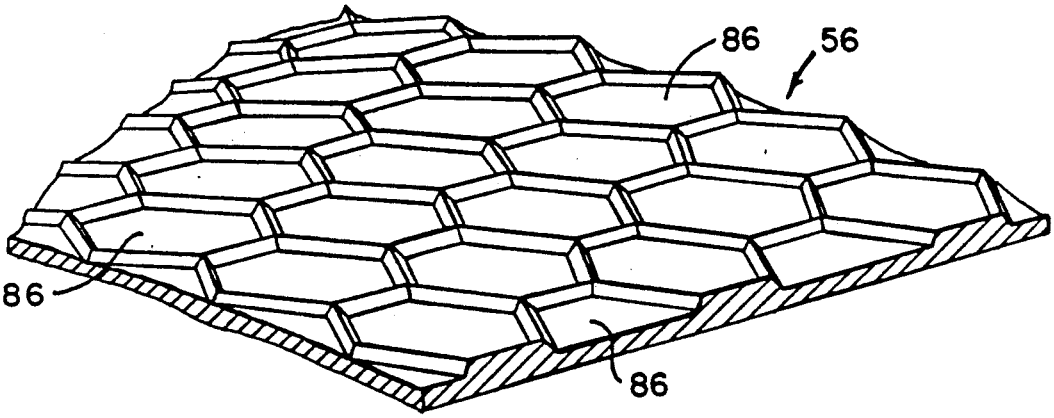
FIG. 7 is a greatly enlarged view, in perspective, of a portion of the most preferred rotogravure roll used in the manufacture of coated abrasive material in accordance with the invention, showing the hexagonal-shaped cells provided in the roll surface.

Referring now to the drawing there is shown in FIG. 1 thereof, in cross-section, coated abrasive material 10 according to this invention which comprises, in general, a backing member 12 and an abrasive layer 14 adhered to the top surface 16 thereof.

Abrasive layer 14 is provided on the backing member 12 by coating a dispersion 18 of abrasive grain 20 in a radiation curable binder 22 onto the bottom surface (top surface 16 in the finished coated abrasive material) of the backing member 12, as hereinafter more fully described. Afterwards, the radiation curable binder 22 is cured through a free radical mechanism induced by exposure to actinic (ultraviolet) radiation or electron beam so as to harden the binder and to secure the coated abrasive layer 14 to the backing member. Quite advantageously, the dispersions of this invention lend themselves to cure by ultraviolet light (UV light), as well as by electron beam.

Figure 2:
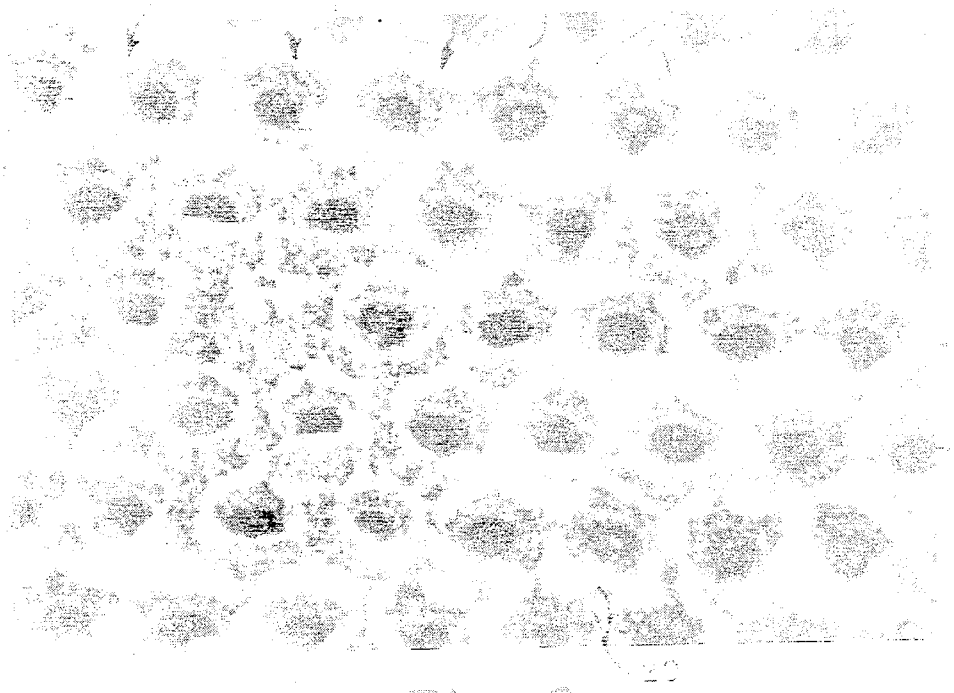
FIG. 2 is a photomicrograph at 40 x magnification of a plan view of the coated abrasive material shown in FIG. 1 showing the unique pattern of coated abrasive formations provided on the coated abrasive material.
Figure 3:
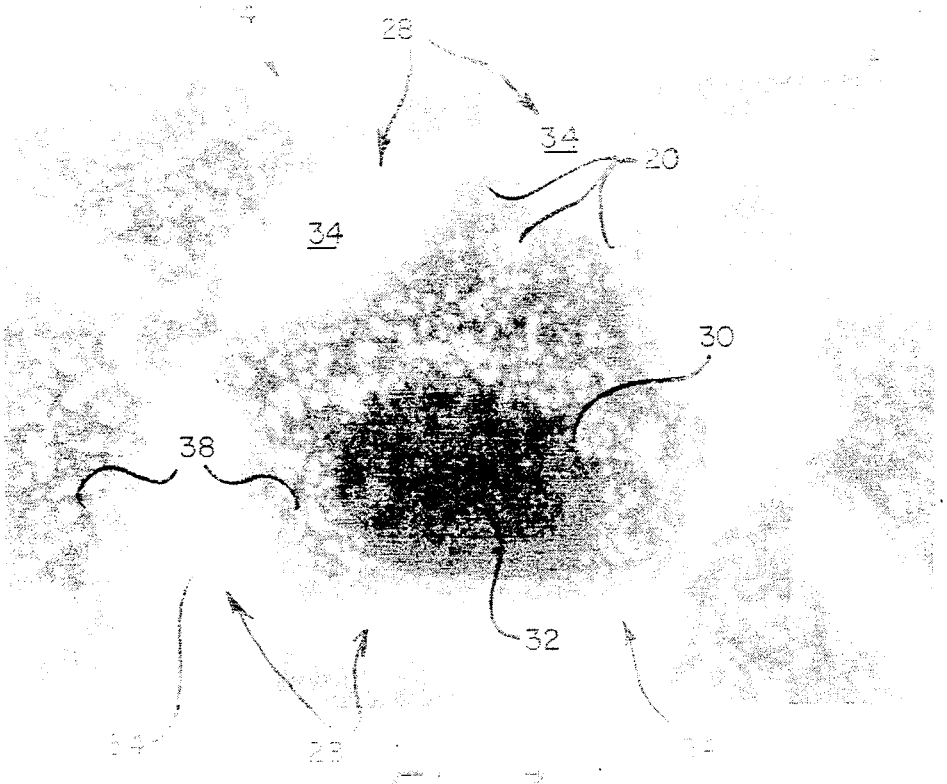
FIG. 3 is a photomicrograph at 200 x magnification of a plan view of the coated abrasive material shown in FIG. 2 showing one of the abrasive formations in the pattern of contiguous abrasive formations.
Figure 4:
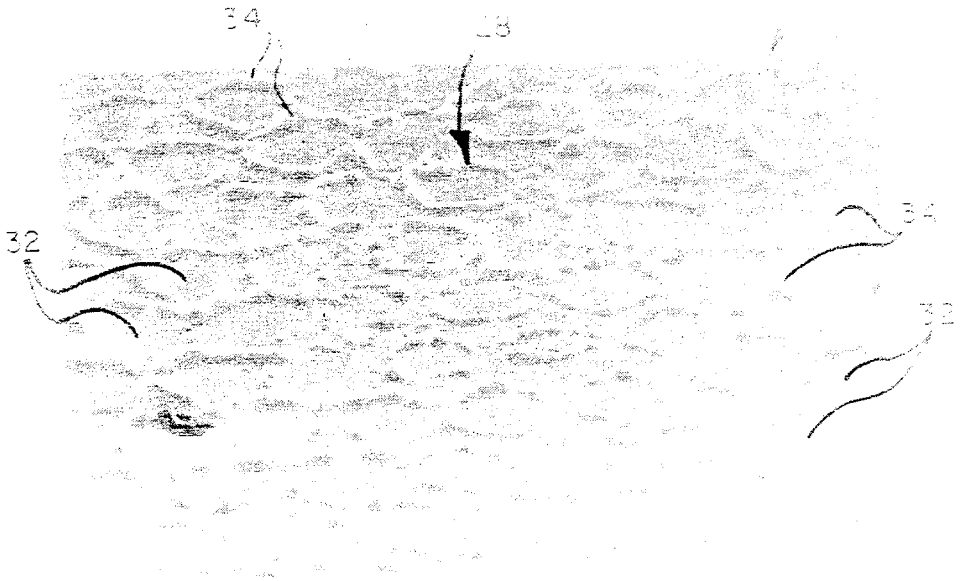
FIG. 4 is a photomicrograph at 50 x magnification of coated abrasive material according to the invention taken at a 60° tilt from the horizontal.

The abrasive layer 14, as is shown more clearly in FIGS. 2 and 3 of the drawing, is characterized by a relatively uniform, grid-like pattern of a plurality of parallel rows 24 disposed at an angle of ninety degrees to a plurality of other parallel rows 26, each of said rows having therein a plurality of abrasive formations 28. The abrasive formations in next adjacent rows are set off from one another, to the right and left, as seen in FIG. 2. As will be further appreciated from FIGS. 2, 4, 5, each abrasive formation 28 is contiguous to others in the pattern of coated abrasive provided. By the term "contiguous", it is meant that the abrasive formations are in close proximity to one another. As will be seen by reference to FIG. 5, however, a photomicrograph of a portion of coated abrasive material 10 taken at 100 x magnification, some of the abrasive formations 28 appear to abut with and join to next adjacent formations and others seem to be somewhat spaced-apart therefrom.

The coated abrasive formations 28 (FIGS. 1 and 3) are defined by an inner bottom edge 30 of coated abrasive which, in turn, defines an area 32 on the top surface 16 of the backing member 12 that is devoid of coated abrasive. The abrasive formations 28 are each further defined at their top by a top edge 34 (FIG. 3) which, in turn, defines a somewhat larger area devoid of coated abrasive material. Connecting the top and bottom edges of each of the abrasive formations, as best seen by reference to FIGS. 1 and 3, is an inner wall 38 of abrasive material which tends to slope in graduated manner inwardly in somewhat concave fashion from the top edge 34 to the bottom inner edge 30 of the formation. In cross-section, then, the abrasive formations can be seen to be discrete three-dimensional formations, having cross-sectional widths which diminish in the direction away from the backing member 12.

Figure 5:
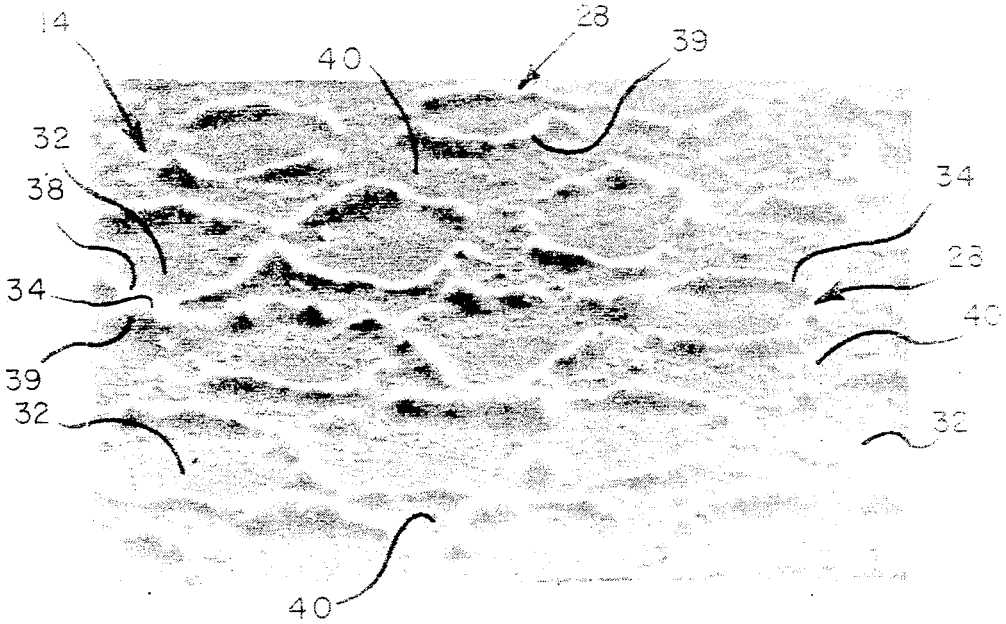
FIG. 5 is a photomicrograph of the coated abrasive material shown in FIG. 4, and at the same angle of tilt, but at 100 x magnification.

It will be appreciated by reference to the drawing, in particular FIG. 5, that with respect to those coated abrasive formations 28 contiguous to one another in the pattern, the top edges 34 are sometimes connected or integral one with the other, whereby to provide a unitary or combined top edge. Other abrasive formations 28 are defined, however, by a distinct outer wall 39 which surrounds that particular abrasive formation and sets it apart from those formations contiguous to it. As will be appreciated further by reference to FIGS. 4, 5, those particular abrasive formations 28 though more or less isolated from one another appear to be interconnected by a matrix 40 (FIG. 5) which surrounds that particular coated abrasive formation and such matrix is shared with other contiguous coated abrasive formations. The matrix 40, as seen in the drawing, joins together outer walls 39 of the contiguous abrasive formations and provides a continuous layer of abrasive material on the top surface 16. Nevertheless, importantly, this layer or matrix 40 (except where the top edges of contiguous formations are connected) is at a level lower than that of the top edges 34 of the abrasive formations 28 (FIG. 1). Thus, there results in what amounts to a discontinuous layer of abrasive material having the unique surface pattern of the invention.

The particular shape that the top edge 34 of an abrasive formation takes will depend somewhat upon the particular pattern carried in the surface of the gravure roll used in the manufacture of the coated abrasive material. The more preferred shape defined by the top edges of the coated abrasive formations, as shown in FIG. 2 is, in general, a hexagonal-shape. The important thing is, however, that a top edge is formed which defines an area on the backing member 12 and in the abrasive coating provided thereon that is devoid of abrasive coating. Thus, the patterned surface coating provided has a unique surface topography that provides a discontinuous surface of coated abrasive. It was quite surprising, and quite unexpected, that, contrary to past experience, such a patterned coating as set forth herein could be obtained by gravure roll coating of the adhesive/abrasive grain slurry onto the backing member. Such manner of coating generally transfers a pattern reflected by the design cut in the gravure roll, not merely an outline of such pattern. Nevertheless, it was discovered that as the coating dispersion viscosity increased poorer and poorer coatings were obtained until suddenly a discontinuous pattern resulted such as disclosed in the drawings. It was, moreover, quite surprising to find that such a patterned coating showed excellent performance in ophthalmic fining.

The adhesives or binders used in the patterned coated abrasive layer of the invention comprise essentially a unique combination of radiation curable monomers having mono-, di, and tri- acrylate functionality. Importantly, the monofunctional monomer is N-vinyl-2 pyrrolidone, a cylic amide derivative of a tertiary amine. Such monomer has been discovered not only to be unique in that it provides improved adhesion between the adhesive binder and abrasive grain but also because it results in good dispersions of the abrasive grains in the adhesive/abrasive grain slurries used in the practice of the invention. This apparently results from the fact that such monomer is hydrophilic as is the aluminum oxide grain used; however, we do not wish to be limited to this theory. Importantly also is the fact that the vinyl pyrrolidone monomer functions in the adhesive formulation as a reactive diluent whereby the desired viscosity and other rheological properties of the binder/adhesive grain dispersion can be adjusted as desired.

It is of critical importance, however, that only a limited amount of the vinyl pyrrolidone be used in the adhesive binder formulations. Such monomer wants to copolymerize only with curing of the adhesive formulation by ultraviolet exposure, as later more fully disclosed. Thus, the amount of vinyl pyrrolidone in the binder composition should be less than about 20% by weight, generally less than about 15% by weight. The more preferred formulations will comprise from about 10–15% by weight vinyl pyrrolidone. With regard to the monomers having diacrylate functionality, it is preferred that a combination of such be used in the binder formulations, namely, diacrylated epoxy oligomers and diacrylate monomers. The preferred acrylated epoxy oligomers are the diacrylates of epoxy resins of the bisphenol-A type. Such acrylated oligomers are readily available commercially under such tradenames as Celrad from Celanese Corporation and Novacure from Interez, Inc. The preferred such oligomers are amine modified acrylated epoxy monomers. Moreover, the preferred such diacrylate oligomers have average molecular weights per acrylate unit of about 250 to 900, with a range of 270–400 most preferred.

Small amounts of higher and lower oligomers, characteristically present in all practical products of this type, have no known harmful effect. Oligomers terminating with unsubstituted acrylate groups are preferred, but methacrylates or other substituted acrylate groups could also be used.

The preferred diacrylated monomer is hexanediol diacrylate ("HDODA") but, in some cases, tetraethylene glycol diacrylate and tripropylene glycol diacrylate can also be used. In order to achieve satisfactory coated abrasive products according to this invention, it is necessary to use substantial amounts of the triacrylated monomers. Trimethylolpropane triacrylate ("TMPTA") is usually preferred in the practice of this invention, primarily because it is reported to be least likely of all the commercially available triacrylated monomers to cause allergic skin reactions. Minor amounts of acrylated monomers with four or more acrylate groups per molecule can be used, however, in lieu of part of the triacrylates.

The relative amounts of diacrylated monomers and triacrylated monomers is adjusted along with variations in the other components of the adhesive mixture e.g., the vinyl pyrrolidone and the acrylated epoxy oligomer, to give suitable rheological properties, in particular viscosity, for coating, as well as effective grinding and/or finishing characteristics to the coated abrasive material ultimately made with the adhesive. A mixture of HDODA and TMPTA in a weight ratio of about 0.45 is preferred.

For all types of acrylated monomers used in this invention, unsubstituted acrylates are preferred but substituted ones such as methacrylates could be used. The average molecular weight per acrylate unit of suitable monomers varies from 95 to 160, with 95– 115 being preferred.

The preferred binder compositions of this invention should comprise from about 25% to about 40% by weight of the triacrylated monomer (TMPTA), from 10% to about 20% by weight of the diacrylated monomer (HDODA), and from about 20% to about 50% by weight of the acrylated epoxy oligomer. Importantly also, the binder composition will include from about 10 to 20% of vinyl pyrrolidone.

The binder composition, to cure the above-disclosed radiation curable components, should also include a photoinitiator which will adequately absorb and transfer to the acrylate components the energy from the UV lamps used to initiate cure. Methods for determining the amounts and types of photoinitiator used are conventional in the art of UV light cured surface coatings, and the same methods were found effective for purposes of the present invention. The amount of photoinitiator is generally from about 0.5 to 7.0% by weight of the amount of adhesive used.

The photoinitiator preferred for use in the practice of the invention for fining product embodiments of this invention is 2.2-dimethoxy-2-phenyl acetophenone (hereinafter DMPA). However, 2-chlorothioxanthone, benzophenone, and 1-hydroxycyclohexyl phenyl ketone, may also be used, along with many others known in the art.

Other components may also be found useful to be included in the binder composition, e.g., coupling agents and adhesion promoters, and colorants to give a particular color to the abrasive products. Examples of adhesion promoters are the organosilanes and organotitanates containing at least one organic group with from 10–20 carbon atoms. An often preferred material, especially for products to be used for lens fining, is tetrakis [(2.2-diallyloxymethyl) 1-butoxy] titanium di(-tridecyl) monoacid phosphite. In the case of colorants, as with other components, care must be taken to select those which will not unduly absorb the UV light and thus interfere with curing of the radiation-curable components of the binder. As usual, in coating compositions, the binder compositions disclosed herein can also include suitable surfactants and foam suppressants.

The abrasive grains, which will be found most suitable for use in the practice of the invention, will depend somewhat upon the particular application and the manner of curing the binder. Curing of the binder is most desirably accomplished by electron beam or actinic radiation, i.e., such as by exposure to ultraviolet (UV) light. Nevertheless, electron beam curing, while effective, requires significantly greater capital investment than curing by UV light. Moreover, such manner of curing presents a more serious potential hazard to manufacturing personnel. In any event, the binder composition useful in the practice of this invention have been found quite advantageously, to be curable by UV light. Thus, white aluminum oxide abrasive grains are usually preferred, as such are not a strong absorber of UV light. Moreover, such mineral scatters light and is advantageous to the UV curing in this invention. For second fining applications, moreover, we have discovered that the most preferred abrasive grains found suitable are high purity aluminum oxide abrasive grain. Nevertheless, whatever the abrasive grain used, it must have adequate transmission for UV light so as not to interfere with curing of the binder.

A representative abrasive grain meeting these requirements is a precision graded aluminum oxide, a product of the Norton Company. Such abrasive grain, as desired, can, moreover, be termed a "virgin" grain which means that it contains no additives which are customarily added to abrasive grain to improve wettability, ease of dispersion or to reduce flocculation. Such additives have been discovered to be detrimental to the proper functioning of abrasive grain in radiation curable formulations. They tend to increase the hydrophilic nature of the surface of aluminum oxide particles which is undesirable when the grain is to be dispersed in a radiation curable, mostly hydrophobic coating liquid. The abrasive grain used in the invention is, moreover, air classified, i.e., during the grading process of the starting aluminum oxide grain mix, no water or dispersant is used.

The particle size of the abrasive grains used can vary somewhat depending upon the particular finishing or lapping operation for which the coated abrasive material is intended. In general, however, the abrasive grain size used should be from about 0.2 to 35 microns. For a product for second fining in ophthalmic finishing operations, the preferred grain size is from about 0.5 to 12.0 microns, even more preferably from about 2 to 4 microns. Where the coated abrasive material is intended for first fining applications, the grain size can range from about 12–20 microns. Coated abrasive material for camshaft finishing can have abrasive grains ranging from about 9–30 microns.

The precision alumina grain is sorted into the appropriate fractions of average (nominal) particle size by air-classification methods according to techniques well known to those in the abrasive art. In the present invention for second fining applications, the nominal particle size that has been found to be most useful is in the range of 0.5 to 12.0 microns, more preferably 2–4 microns, as above-disclosed. The air classified abrasive grains most preferred for second fining applications should be about 3 microns and dry ground. Air classified (precision graded) grains are most preferred for use in the practice of the invention because in wet classification dispersions aids such as sodium silicate or various organics such as sodium polyacrylate are necessary to achieve good aqueous dispersion. The dispersion aids tend to remain on the surface of the grain particles rendering them hydrophlic. The term "precision graded" means that for any particular size, the deviation from the average cannot be greater than four times the stated grade, in either direction. For the more preferred second fining product of the invention, it is preferred, moreover, that the mass ratio of abrasive grains to binder in the dispersion to be coated be from about 1.0 to about 3.0, more preferably from about 1.5 to 3.5.

It has been discovered that it is of critical importance, in particular, in products useful for second fining applications, that the abrasive grain particles be pretreated with a coupling agent prior to being dispersed in the liquid binder components. The preferred coupling agent is gamma-methacryloxypropyl trimethoxy silane commercially available from Dow Corning Corp. under the trade designation Z 6030 and Union Carbide Corp. under the trade designation A-174. Preferably, the amount of silane to be bound to the grain surface is in the range of from about 0.1%–5%, even more preferably from about 0.2% to about 1.0%, based upon the weight of the aluminum oxide or other abrasive grains. Other silane coupling agents can, instead, be used, if desired. For example, vinyl, vinyl-alkyl, cyclohexl or acryloxy, methacryl, etc. silanes may be found suitable for use in the practice of the invention. Amino silanes may also be found useful in the practice of the invention. The silane is first dissolved in water or in a solution of water:methanol (e.g., a 9:1 solution) prior to application to the abrasive grains. Preferably, however, the A-174 silane will be hydrolyzed, preferably in deionized water prior to application. After treating the abrasive grain with such coupling agent, moreover, it is preferred that such pretreated grains go through a conditioning or ripening period, prior to being subjected to drying. Such a ripening period should last for several hours, e.g., from overnight to 15–18 hours. Next, the pretreated abrasive grains are dried at a temperature above 100° C. for several hours, e.g., 110° C. for 4 hrs, after which they are screened to break up any agglomerates.

The backing members for use in this invention will depend to some extent upon the particular application involved. For ophthalmic lens fining applications, it is necessary that the backing member should be waterproof, since the product is normally used wet; that the strength of the backing should be sufficient to resist tearing or other damage in use; that the thickness and smoothness of the backing should allow the achievement of the product thickness and smoothness ranges noted further below; and that the adhesion of the adhesive to the backing should be sufficient to prevent significant shedding of the abrasive/adhesive coating during normal use of the product. These requirements are most readily met by the use of flexible and dimensionally stable plastic films or waterproof paper as the backing. The most preferred film backing member is polyethylene terephthalate film. Nevertheless, for some applications, other polymeric films, e.g., polycarbonate films, will be found suitable. Such backing members should, in general, be primed or pretreated to promote adhesion between the surface pattern of coated abrasive and the polyester backing member. Various of such primed or pretreated polyster films will be found suitable in the practice of the invention, e.g. Melinex 505 polyester film from ICI Americas Inc., Hostaphon 4500 from American Hoechst Corporation, and Mylar 300XM, available commercially from E. I. DuPont de Nemours Co. Such a film is disclosed in U.S. Pat. No. 4,476,189, which issued on Oct. 9, 1984 and entitled "Copolyester Primed Polyester Film" and in "Polyester Film for Printing", an article published in "Screen Printing", May, 1982, authored by Dr. B. Lee Kindberg, the complete disclosure in the patent and article being herein incorporated by reference.

The thickness of the backing member will depend to some extent upon the particular application for the coated abrasive material of the invention. It should be of sufficient thickness to provide the strength desired to bear the patterned coating and for the application intended. Nevertheless, it should not be so thick as to adversely affect the desired flexibility in the coated abrasive product. Typically, the backing member should have a thickness less than about 10 mils, preferably in the range of from about 2 to 5 mils.

Figure 6:
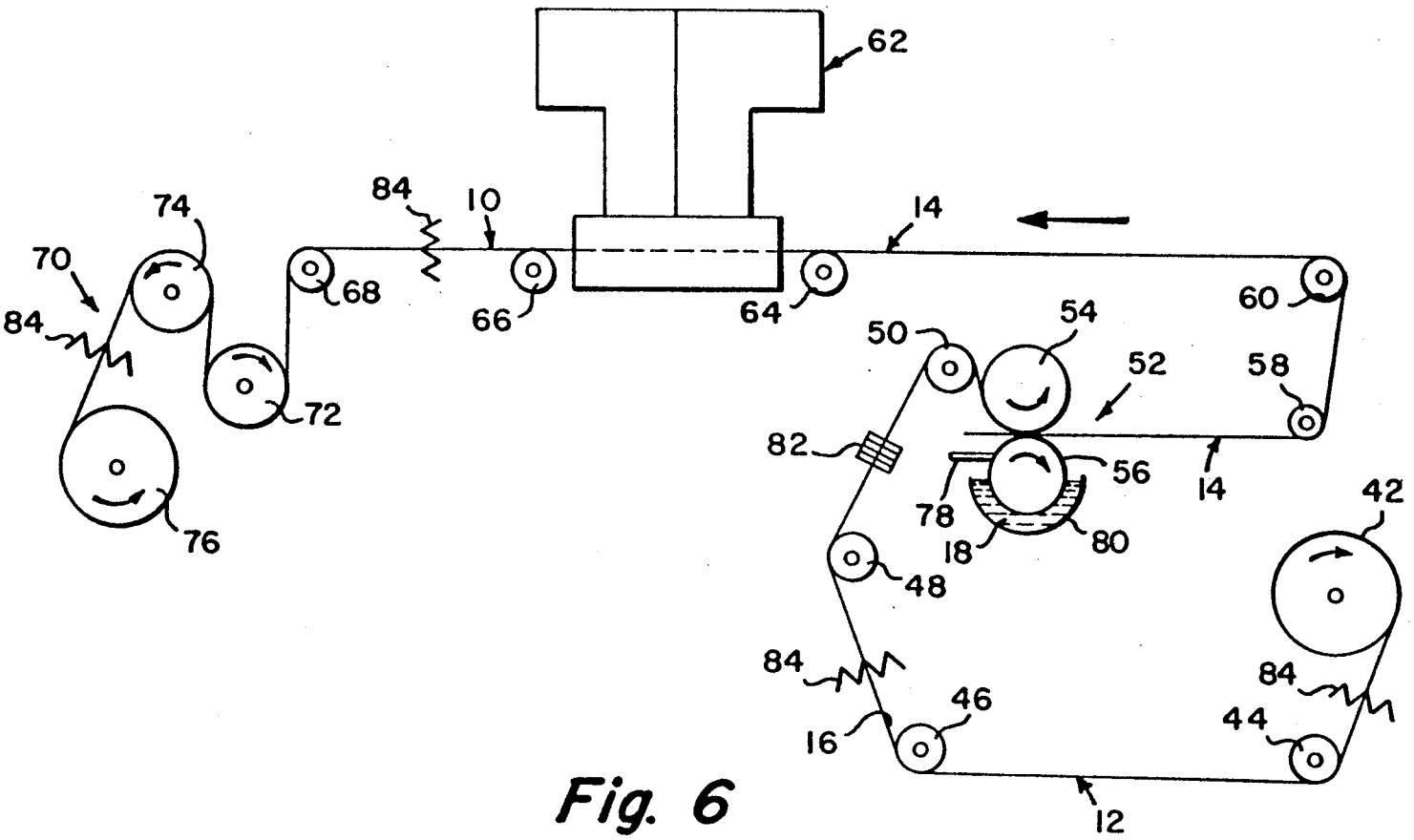
FIG. 6 is a schematic view of the manufacturing process used to manufacture the coated abrasive material of the invention.

In the continous manufacture of the coated abrasive material 10 according to the invention, as disclosed by FIG. 6, the backing member 12 is withdrawn in conventional fashion from a roll 42 thereof provided on a conventional unwind stand (not shown). The unwind stand is fitted with a brake, according to usual practice, to give the desired resistance to unwinding of the backing member. The backing member 12, as shown in the drawing travels from the unwind area around one or more suitable rolls designated by reference numerals 44, 46, 48 and 50, and thence to the coating area denoted generally by reference numeral 52 whereat it is passed between the nip formed by roll 54 and gravure roll 56, rotating in the directions indicated by the arrows. Thence the backing member 12 with the abrasive coating 14 coated thereon is passed around one or more rolls 58, 60 to a source 62 of actinic light, i.e., ultraviolet(UV) light, which provides the means for curing of the binder composition to the desired hardness. Rolls 64, 66 provide that the coated abrasive material 10 travels in horizontal disposition through the curing zone. From the curing zone, the coated abrasive material 10 travels over roll 68 to a conventional takedown assembly denoted generally by reference numeral 70 and which comprises roll 72, a rubber-covered roll 74, and compressed air driven takedown roll 76 which functions according to usual technique to provide a wrinkle-free, tightly wound roll of coated abrasive material.

The radiant power of the source of actinic light can be provided by any conventional UV souce. For example, in the practice of the invention, the UV light producing components were successive Model F440 10 lamp holders, fitted with one Type D followed by one Type H lamp. A total energy output of 300 watts per inch of width is provided. The power supply for each lamp was designated Type P 140A.

In some cases, additional heat input can be provided, if desired, by conventional thermal means. The main consideration, however, is that the radiant power of the UV light source 62, together with any optional thermal heat input from other sources (not shown) located between UV light source 62 and the takedown rubber-covered idler contact roll 72 must be sufficient to cause the desired curing, i.e., hardening, of the binder before the coated abrasive material reaches the roll 72.

The intensity and time of exposure of the coated abrasive material to the UV light and to any auxiliary thermal heating used are determined by methods well known in the art of coating with adhesives cured by exposure to UV light, supplemented if necessary by testing of the grinding or other surface finishing performance of the coated abrasive materials produced.

For lens fining applications, the thickness of coating in itself is not inherently critical, but a combined thickness of the backing member and the surface coating has become established as standard in the industry and is relied upon to give the proper lens curvature when used with the backup lapping tool supports which are conventional. THe thickness range, 175–230 microns, established in the art can readily be produced according to this invention. The uniformity of thickness is inherently critical, because if the thickness of coating varies excessively from one part of the abrasive to another, it is possible for one part of the lens to escape proper polishing, as a result of a low spot on the abrasive, or to be excessively thinned, by a high spot on the abrasive. The combined thickness of the backing member and the patterned adhesive/abrasive layer over the surface of the portion of coated abrasive material used for a single lens should not vary by more than 25 microns, when measured with an instrument, such as a conventional micrometer, which measures the thickness of local high spots on the coating over an area of at least 0.05 square centimeters.

Of critical importance, however, in obtaining the patterned surface coating of abrasive grain, dispersed in the binder, as shown in FIGS. 1–5, is the use of a particular rotogravure roll and a binder/grain dispersion having non-Newtonian flow characteristics. In the practice of the invention, an 80-Hex, R-11 gravure cylinder, available commercially from Consolidated Engravers, Corp., was used. It is well known in the art of gravure printing that in such designation 80 refers to the number of cells, in this case hexagonal-shaped, per linear inch and R-11 denotes the particular toll that was used to generate the cells. This latter number is related to cell depth and thus the combination 80 Hex and R-11 defines a particular cell shape as well as cell volume, The total theoretical cell volume of this particular roll is $22.1 \times 10^9$ cubic billion microns/in.$^2$. Each cell has a depth of 0.0049 inches. Other manufactures, however, produce rolls having the same or a similar pattern, and such may also be found useful provided they meet the other requirements set forth herein.

The dispersion coating must be of high viscosity and possess non-Newtonian liquid flow characteristics, we have discovered, for the patterned surface coating to be produced. Otherwise a continuous surface coating will result when the dispersion coating is transferred to the backing member. The particular viscosity of any dispersion coating formulation, as will be readily appreciated by those in the art, will, of course, depend upon a number of factors in combination with one another, e.g., the particular components used, the relative weights thereof in the dispersion, the relative amount of abrasive grains and other solids that might be present. As an example of a suitable dispersion viscosity for production of the patterned surface coating disclosed herein, the viscosity should be about 1750 cps (Brookfield viscometer, spindle #2, at 6 rpm) at 76°F. and 3400 cps (spindle #2, at 30 rpm), indicating that the dispersion possesses non-Newtonian liquid flow characteristics. Importantly, no heat is applied to the coating dispersion that could possibly change its viscosity and provide greater ease in coating.

Without being bound by the explanation offered here, it is felt that the unique combination of relatively high dispersion viscosity, non-Newtonian liquid flow characteristics, and the gravure cells are only incompletely filled with the dispersion coating material and thus it becomes impossible to generate a continuous coating. Fractional transfer of liquid from the perimeter only of completely filled gravure cells might provide an alternative explanation. In either event, we have discovered that with particular, radiation-curable coating formulations, as disclosed in this application, it is possible to generate patterned coatings repeatedly and reproducibly, while non-patterned coatings are obtained from relatively low viscosity coating liquids or dispersions with a low grain to resin ratio. This ratio is defined as the quotient obtained from dividing the weight of grain used by the combined weight of oligomers and monomers present in the formulation. In general, such a ratio should be preferably in a range of from about 1.5 to about 2.5.

Other gravure rolls have different cell patterns, e.g., quadratic, pyramidal, may also be found suitable in producing a surface coating defining useful geometrical patterns of coated abrasive other than the hexagonal-shaped pattern resulting in this invention, provided the dispersion being coated meets the other requirements set forth herein.

The preferred embodiments of the present invention may be further appreciated from the following examples. All preparations set forth herein are to be understood as being based upon mass or weight, unless otherwise stated.

Example No. 1 Coated Abrasive Product Suitable for Second Fining Ophthalmic Operations The components listed below, except for the coloring agent and abrasive grain were readily mixed together without special care to form a "clear liquid" About three-fifths of this clear coat was then separately mixed with the coloring agent for at least 15 minutes to assure thorough mixing; the remainder of the clear coat was then added and mixed until uniform color was achieved.

A dispersion of the mixed ingredients and the abrasive grain was then prepared on a standard Ross type double planetary mixer, according to usual techniques, at a medium speed for 30 minutes.

| Ingredients | Parts by Weight |
|---|---|
| Acrylate ester of epoxy resin (Celrad 3600)[1] | 100 |
| Trimethylol propane triacrylate (TMPTA)[2] | 132 |
| 1.6 hexane diol diacrylate monomer (HDODA)[3] | 60 |
| N-Vinyl-2 pyrrolidone (V-Pyrrol)[4] | 60 |
| Reactive Acrylic Pigment (Penn Color 9R-75)[5] | 10 |
| Titanate coupling agent (KR-55)[6] | 1 |
| Fluoro chemical surfactant (FC-171)[7] | 2 |
| Dimethoxy phenyl acetophenone (Irgacure 651)[8] | 18 |
| Defoamer (Byk-A-510)[9] | 2 |
| Silane treated aluminum oxide abrasive grain (3 micron) | 870 |

[1]Celrad 3600, like Novacure 3600 (Example 5), is an amine modified diacrylated epoxy oligomer of the bisphenol-A type.
[2]TMPTA was supplied by Interez, Inc.
[3]HDODA was supplied by Celanese Plastics and Specialties.
[4]V-Pyrrol was supplied by GAF Corporation.
[5]Penn Color 9R-75, available from PennColor gives the product a purple color. Other colors could also be used, if desired.
[6]KR-55, available from Kenrich Petro Chemicals, Inc., is tetra (2,2 diallyloxymethyl-1-butoxy) titanium di (ditridecyl phosphite).
[7]FC-171, available from 3M Company, is a fluorocarbon surfactant.
[8]Irgacure 651, available from Ciba Geigy Co. is a photoinitiator.
[9]Byk-A-510, available from BYK MallinKrodt Company is a solvent containing bubble breaker (foam suppressant).

The viscosity of the mix at 76° F. was determined to be 1750 cps (Brookfield viscometer, spindle 2 at 6 rpm) and 3400 cps (spindle 2 at 30 rpm) indicating that the dispersion was non-Newtonian.

The above coated abrasive dispersion was coated on 3 mil. Melinex 505 ®polyester film, a biaxially oriented, high clarity film pretreated to promote adhesion, commercially available from ICI Americas Inc., using a conventional 80 Hex, R-11 gravure cylinder at 30 feet per minute web speed. The coated abrasive layer was cured with two Fusion Company medium pressure mercury vapor lamps. A coating weight of 0.8 pounds per ream was provided on the polyester film backing member. A ream is equivalent to 330 square feet of coating area.

The speed of the gravure roll 56 was maintained so that the periphery of the roll matched the backing member 12 in linear speed. Before contacting the backing, the wetted surface of the gravure roll is wiped with a trailing doctor blade 78. A Benton type A blade constructed of Type 304 stainless steel, 203 microns thick and 5 cm wide, with a blade angle of 97° was found satisfactory when used at an angle of 46° to the web at the point of contact. The blade used was supplied by Input Graphics, Inc. The backing member was supported in the coating nip by a non-driven, freely rotating, rubber-coated backup roll 54. The rubber on this roll had a hardness of Shore A-75. For convenience in maintaining cleanliness of the coating, the backup roll was generally undercut so that a zone about six mm in width on each edge of the backing member was not subjected to pressure in the nip and thus was not coated.

The adhesive/abrasive grain slurry was supplied to the gravure roll 56 from a coating pan 80 which was kept filled to a constant level via a recirculation loop not shown. A pump in the recirculation loop maintained constant agitation of the slurry, so that settling of the denser abrasive component did not occur to any significant extent. No heat was applied to this pan, the dispersion being coated at room temperature, i.e., about 72–80°F.

The film backing member 12 was passed between felt wipers 82, according to usual technique, to remove any foreign particles therefrom which would endanger the uniformity of the coat, or its adhesion to the backing member. As usual, lengths 84 of loosely suspended copper tinsel connected to a suitable ground are provided on the coating line to eliminate any dangerous build-up of electrostatic charge.

Gravure roll 56, as earlier disclosed, has 80 hexagonal-shaped cells 86 per inch provided in its surface (FIG. 5). The cells, as shown, are provided in rows of cells that extend lengthwise of the gravure roll 56. Those cells 86 in next adjacent rows are staggered to the right and left of the cells in the row next to it. Thus, any particular cell 86 in the coating roll is in contact with other cells and those cells inwardly of the edge of the cell pattern are surrounded by a plurality of other cells, in this case six.

The dispersion coated backing member was exposed for about two seconds at a web speed of about 20–40 ft./min. to the output of the mercury vapor UV lamp with radiant power of about 300 watts per inch of width.

A unique, three dimensional, uniformly thick pattern of coated abrasive was provided, as shown in FIGS. 1–5. The coated abrasive pattern is seen to be defined by a plurality of coated abrasive formations 28 each of which is contiguous to and some are interconnected with other such coated abrasive formations. Each of the coated abrasive formations 28 is defined by a bottom edge 30 which defines an area 32 on the backing member which is approximately of a circular-shape and which is devoid of any coated abrasive. The top of each coated abrasive formation 28 is further defined by a top edge 34 which, in turn, defines a somewhat larger area devoid of coated abrasive. These two edges are connected together by a sloping inner wall 38 of abrasive coating which, as best seen from FIG. 3, curves inwardly somewhat from top to bottom in a somewhat concave fashion. As will be appreciated from the white areas shown in FIG. 2 of the drawing, such areas indicating the presence of abrasive grain, the abrasive grain particles in the patterned coating are somewhat concentrated at the top edges of the coated abrasive formations. Nevertheless, as the white areas in the photographs indicate, the abrasive grain particles 20 are dispersed throughout the coated abrasive formation from top edge 34 to bottom edge 30, decreasing somewhat in concentration from top to bottom. In general, the coated abrasive pattern provided is defined by a plurality of void areas, i.e., by a plurality of abrasive formations each defining an area with no coated abrasive. The pattern has the appearance of a surface having a plurality of rather uniform craters like found in volcanos. The craters are alined in parallel rows and are offset from one another in a right and left manner in next adjacent rows whereby a grid like pattern results of what might be termed vertical and horizontal rows of craters and coated abrasive formations.

Figure 8:
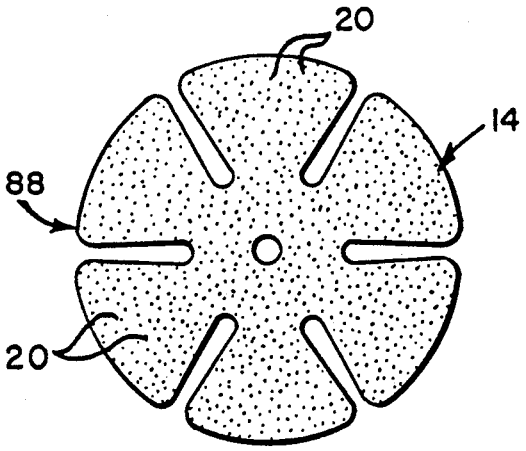
FIG. 8 shows a plan view of a so-called "Snowflake" abrasive pad cut from the coated abrasive material of the invention used in the finishing process for ophthalmic lens.

Snowflake fining pads, i.e., pads 88, having the shape shown in FIG. 8, were cut from this coated abrasive material, according to usual techniques. Afterwards, the fining pads were tested on a conventional Coburn Model-505 ophthalmic finishing machine using the standard two-step fining procedure to complete the fining of a cylindrical, 6.25 diopter, 10 cm. diameter plastic lens. The pads were mounted in usual manner by pressure-sensitive adhesive to the lapping tool backup structure described in the Stith patent cited earlier. The initial thickness of the lens blank was measured and the lens clamped in position. The pressure urging the coated abrasive lapping tool against the lens blank was adjusted to 20 psi force. The machine was then operated for three minutes. During that time the lens and lapping tool were flooded with water.

The criteria prescribed for a successful result of this test for second fining application are: (1) removal of from 0.03 to 0.06 mm from the center of the lens; (2) a lens surface finish of not more than 6–8 microns AA and not more than about 60 microns Rt (depth for the deepest single scratch within a standard traversal range of the surface measuring instrument); (3) general uniformity of the lens surface, and (4) lack of appreciable shedding of the coating of the coat abrasive lapping tool. The lens was removed and final thickness measured. Finish was determined with a Surtronic 3 instrument, according to conventional techniques.

Snowflake fining pads, cut from commercially available coated abrasive material, as earlier disclosed, having aggregates of abrasive provided thereon were used as a control. These pads were tested on the Coburn Model-505 ophthalmic finishing machine in the same manner as the product according to this invention and above-described.

The results of the two tests, comparing Snowflake second fining pads from the two different coated abrasive materials, are shown in Table I below:

TABLE I

Comparison Between Snowflake Pads of Aggregate Containing and Pattern Coated Abrasive

| Fining Pad Material | Location of Measurement | Finish Lens Quality | | | |
|---|---|---|---|---|---|
| | | Ra | Rt | Cut | Erosion |
| Control Abrasive | Right | 8 | 85 | — | — |
| (Aggregate | Center | 4 | 30 | 0.05 mm | none |
| Containing) | Left | 4 | 34 | — | — |
| Pattern Coating | Right | 4 | 42 | — | — |
| (Silane Treated | Center | 4 | 36 | 0.06 mm | none |
| Abrasive) | Left | 5 | 44 | — | — |
| Non-Pattern | Right | 7 | 48 | — | some at 20 |
| (Continuous | Center | 6 | 56 | 0.01 mm | excessive at |
| Coating) | Left | 6 | 32 | — | 32 psi |

As indicated in Table I, the Snowflake pad obtained from the coated abrasive material according to the invention, and that manufactured from the aggregate abrasive material are equivalent in performance. Accordingly, satisfactory cut rate and fine lens finishes can be obtained from non-aggregate abrasive grain containing coatings of the present invention leading to substantial reduction in manufacturing cost of abrasive material for production of Snowflake pads.

By further comparison, a coated abrasive material having a continuous coating on the backing member was made from the same dispersion as that used for the patterned coating. A Consler wire-wound coating bar was used instead of the gravure cylinder having the hexagonal cell structure, to obtain coating weights comparable to that of the patterned coating. Although acceptable fining quality, as indicated in Table I, was obtained from the continuous coating material, the cut value is seen to be unsatisfactory because it is well below the required 0.03–0.06 mm value. Furthermore, there is evidence of erosion or shedding of the coated abrasive on the Snowflake fining pad having the continuous i.e., the non-patterned, coating after the fining process. Such characteristic also indicates unsatisfactory performance.

The abrasive grain used in this example is a precision graded, virgin aluminum oxide (Norton Company-Type 7920). These abrasive grain particles were air-classified, instead of being classified by the more common and cheaper sedimentation-or slurry-classification method. This latter method tends to introduce large amounts of surface-bound water on the individual grain particles. Such bound water, in turn, tends to render the grain hydrophilic and ineffective in the radiation curable binder system used which contains mostly hydrophobic ingredients, as will be better appreciated hereinafter.

The abrasive grain, after classification into the desired size range, was treated by spraying a dilute solution of gamma methacryloxypropyl trimethoxysilane (Trade designation "A-174", available commercially from Union Carbide Corp.) dissolved in a 50:50 mix of deionized water:A-174 onto the abrasive grain particles by mixing in a conventional Hobart mixer for 15 minutes. The 50:50 mix was stirred, prior to mixing with the abrasive grains, until such was a clear solution, indicating that the A-174 had hydrolyzed. The hydrolyzed A-174 was then mixed with abrasive grains in an amount of 30 gms hydrolyzed A-174:1500 grams grains, after which the silane pretreated abrasive grains were allowed to "ripen" for eighteen hours prior to being subjected to drying. The "ripened" silane treated abrasive grain particles were then dried at 110° C. for four hours, and the coated grain particles were then pulverized according to usual techniques to the desired size range, and screened through a 78 ss wire. The pick up by the grain particles of the silane was determined to be about 1%, based on the the weight of the abrasive grain.

The performance of a candidate material for ophthalmic lens fining is usually defined in terms of the quality of finish generated consistently together with the presence or absence of signs of erosion of the coated abrasive on the used fining pad. Erosion or removal of the coating from small areas, especially at the edges of a fining pad, is usually taken as a sign of non-reliable product performance. Coatings that show erosion are normally rejected. Lens finish quality is commonly measured by the Ra and Rt values taken from traces at various spots (e.g. at the center and at the left, right edges) along the finished lens. The meaning of these statistical parameters is well known to those skilled in the art. Such are clearly defined in a publication entitled "An Introduction to Surface Texture and Part Geometry" by Industrial Metal Products Incorporated (IMPCO), the complete disclosure of which is incorporated herein by reference. In general, Ra is a measure of average surface roughness. Since many surfaces of differing topography might yield similar Ra values, this number is usually supplemented by other parameters generated from the same surface. In the ophthalmic finishing art, Rt is often employed to supplement the Ra measurement. The value of Rt is a measure of the depth of gouges or scratches that might remain on the lens surface after fining. These scratches must be removed from the lens surface in the slurry-polishing process.

Example No. 2 Comparison of Coated Abrasive Products Using Precision Graded Abrasive Grain Which Has Been Slurry Classified Against Air Classified Grain Patterned coated abrasive material was manufactured as set forth in Example 1; however the aluminum oxide abrasive grain used was a different precision graded aluminum oxide grain (Norton-Type 7995). With this type grain, however, the abrasive grain particles are slurry classified, rather than being air classified. Such was accomplished according to usual techniques with a slurry containing silicates as a dispersion aid. Snowflake pads were cut from this coated abrasive material and tested as set forth earlier. The used pads showed evidence of excessive erosion, indicating the product was totally unsuitable for this application.

Example No. 3 Comparison Between Abrasive Coatings With Silane Treated and Untreated Abrasive Grain This example compares the performance of a second fining product when untreated high purity aluminum oxide abrasive grain (3 micron), as in Example 1, is substituted in the dispersion for the silane treated abrasive grain. Snowflake fining pads were produced and the coated abrasive product incorporating untreated grain was tested, as before, on the Coburn Model-505 ophthalmic finishing machine. The results are set forth in Table II below.

TABLE II

| Fining Pad Material | Location of Measurement | Finish Lens Quality | | | |
|---|---|---|---|---|---|
| | | Ra | Rt | Cut | Erosion |
| Control Abrasive | Right | 4 | 34 | — | — |
| Coating Containing | Left | 4 | 30 | 0.06 mm | none |
| Aggregates) | Center | 4 | 26 | — | — |
| Pattern Coating | Right | 5 | 36 | — | — |
| With Silane | Left | 4 | 35 | 0.05 mm | none |
| Treated Abrasive Grain | Center | 4 | 27 | — | — |
| Pattern Coating, | Right | 5 | 39 | — | unacceptable |
| with Untreated | Left | 6 | 55 | 0.00 mm | at standard |
| Abrasive Grain | Center | 5 | 45 | — | 20 psi |

As can be seen from the test results in Table II, the use of a fine particle size abrasive grain in both pattern coatings results in low Ra and Rt values; however, no measurable stock removal (cut rate) resulted from the use of the abrasive product in which the abrasive grain was not pretreated with silane. Moreover, the untreated abrasive grain product resulted in excessive erosion of the coating, even at the standard 20 psi operating pressure.

Example No. 4 Comparison of Patterned Coated Abrasive Material Having Silane Merely Incorporated In The Dispersion A further coated abrasive product was produced as disclosed in Example 1 having a patterned coating thereon. The abrasive grain, however, was not pretreated with silane. Instead, the silane was merely added to the coating mix (dispersion) in comparable amount. In testing of the Snowflake pads as before, similar results to those obtained from the patterned coating with untreated abrasive grain (Example 3) were obtained. The cut values were low and erosion was excessive. As a result, such a coated abrasive product is not suitable for lens second fining applications. Thus, for good results, it is seen to be critical to the invention disclosed not to just merely provide silane in the binder formulation. It must be provided on the abrasive grains as a pretreatment prior to the grains being dispersed in the binder formulation.

Example N. 5 Comparison of Patterned Coating Of Invention With Product Having A Dot Pattern This example illustrates the unique performance obtained from coated abrasive material having the patterned surface coating resulting from use of the gravure roll having hexagonal-shaped cells provided in its surface.

A formulation was prepared as in Example 1 of the following ingredients:

| Ingredients | Parts by Weight |
|---|---|
| Novacure 3600 | 1000 |
| TMPTA | 1320 |
| HDODA | 600 |
| V-Pyrol | 600 |
| Penn Violet 9R-75 | 100 |
| Irgacure 651 | 180 |
| Zonyl A[1] | 50 |
| Kr-55 | 10.0 |
| Cab-O-Sil M5[2] | 50 |
| Silane Treated Aluminum Oxide Abrasive Grain (3 micron) | 9760 |

[1]Zonyl A, commercially available from duPont, is a surfactant which aids in wetting the abrasive grains and thereby reduces the viscosity.
[2]Cab-O-Sil is a fumed silica thixotropic agent commercially available from the Cabot Corporation.

The viscosity of the above abrasive grain/binder dispersion measured on a Brookfield, Model LV viscometer at room temperature, was determined to be 19,000 cps at 12 rpm (Spindle No. 3) and 37,000 cps at 30 rpm using the same spindle, giving a thixotropic index of 1.95.

The dispersion was coated, according to conventional technique, onto a Melinex ® 3 mil polyester film backing member using a 12-inch pilot size Stork rotary screen printer unit to provide a coated abrasive dot pattern on the backing member. Two cylinders were tested, one (60 HD) with 120 microns diameter openings and 7% open area, and the other (70 HD) with 80 micron dots and 14% open area. Dot patterns were reproduced sharply on the film substrate without significant distortion. The composition was cured with two Fusion System medium pressure mercury vapor lamps as before described.

Snow flake fining pads were cut, according to usual techniques, from each of the dot patterned coated abrasive materials and these pads were then tested in conventional manner on the Coburn-505 ophthalmic fining machine. In each case, the measured cut rate was either zero or near zero. Although the Ra and Rt values were nearly acceptable for both such patterned products, zero or near zero (0.01–0.02 mm) cut values eliminated these coated abrasive materials from possible consideration in ophthalmic second-fining applications.

With the pattern of coated abrasive dots provided on the backing member, the coated abrasive dots are like islands of abrasive material on the backing member surrounded by channels or areas on the backing member devoid of any coated abrasive. On the other hand, when considering the pattern provided on the coated abrasive material of this invention, the pattern comprises void areas, i.e., areas on the backing member each having no coated abrasive thereon surrounded by formations of coated abrasive material.

EXAMPLE 6 Example Showing Criticality of Rheology of Abrasive Grain/Binder Dispersion The criticality of the rheology of the abrasive grain/binder mix in providing the patterned coated abrasive product of the invention is shown by this example.

A dispersion was prepared as before by mixing the abrasive grain with the other ingredients already mixed together, on a Ross double planetary mixer for 30 minutes at the medium speed setting

| Ingredients | Parts by Weight |
|---|---|
| Novacure 3702[1] | 1,100 |
| TMPTA | 1,320 |
| HDODA | 600 |
| V-Pyrol | 600 |
| Penn Voilet 9R-75 | 100 |
| Irgecure 651 | 180 |
| Zonyl A | 5.0 |
| KR-55 | 10.0 |
| BYK A-510 | 10.0 |
| 3 Micron, Silane-Treated Precision Aluminum Oxide Grain | 870 |

[1]Novacure 3702 is available commercially from Interez, Inc. and is the diacrylate ester of the basic bisphenol-A epoxy resin and also contains some fatty acid ester groups.

The viscosity of this binder/grain mix, measured as before, on a Brookfield Model LV Viscometer at room temperature, was determined to be 1,000 cps. (Spindle No. 2, 12 rpm) and 960 cps. (Spindle No. 2, 30 rpm) indicating a dispersion having Newtonian flow characteristics.

When a coating was made with this dispersion, using the same gravure roll used in Example 1, a non-patterned coating was obtained.

In a further adhesive binder/grain mix, the Novacure 3702 was replaced with Novacure 3700, the other ingredients remaining the same. This oligomer has the same backbone as the Novacure 3702 but is without the fatty acid ester groups. Similar unsatisfactory results, as with the Novacure 3702, were obtained.

A further binder/grain mix was obtained by replacing Novacure 3702, with Urethane 783, an acrylated urethane oligomer, commercially available from Thiokol Corporation. A pattern coating as in Example 1 was obtained; however, on testing Snowflake pads made therefrom, erosion was found to be excessive.

Erosion was also found to be extensive in fining pads made from abrasive material made from dispersions not containing the V-Pyrol, or alternately when other diluent monomers such as Sipomer-BCEU are substituted therefor. Sipomer-BCEU, available commercially from Alcolac Corp., is a dimerized form of acrylic acid.

What is claimed is:

1. A coated abrasive material suitable for use in lapping operations comprising:

(a) a flexible and dimensionally stable backing member:

(b) an abrasive grain containing material adhered to one surface of the backing member, said material being configured in a plurality of elongated discrete three-dimensional formations interspersed with areas devoid of abrasive material such that the abrasive grain containing material forms a discontinuous surface opposite the backing member.

2. Coated abrasive material according to claim 1 wherein the abrasive grains in the abrasive material are in the size range of from about 0.2 microns to about 35 microns.

3. Coated abrasive material according to claim 2 wherein the abrasive grains are of aluminum oxide.

4. Coated abrasive material according to claim 3 wherein the size range of the abrasive grains from 0.5–5 microns.

5. Coated abrasive material according to claim 4 wherein the aluminum oxide grain is a virgin grain.

6. Coated abrasive material according to claim 5 wherein the abrasive grain has been air classified.

7. Coated abrasive material according to claim 3 wherein the abrasive grain has been treated with a coupling agent.

8. Coated abrasive material according to claim 7 wherein the coupling agent is a silane.

9. Coated abrasive material according to claim 8 wherein the silane is gamma-methacryloxypropyl trimethoxy silane.

10. Coated abrasive material according to claim 1 wherein the said radiation curable binder comprises an acrylated epoxy resin oligomer.

11. Coated abrasive material according to claim 10 wherein the acrylated epoxy resin oligomer is a diacrylated epoxy oligomer.

12. Coated abrasive material according to claim 1 wherein the said radiation curable binder further comprise an acrylated monomer as a reactive diluent.

13. Coated abrasive material according to claim 12 wherein the reactive diluent is selected from the group consisting of trimethylolpropane triacrylate and hexanediol diacrylate.

14. Coated abrasive material according to claim 1 wherein the backing member is a plastic film.

15. Coated abrasive material according to claim 14 wherein the plastic film is polyethylene terephthalate.

16. Coated abrasive material according to claim 14 wherein the said polyster film has been pretreated with an adhesion promoter.

17. Coated abrasive material according to claim 1 wherein the said formations are provided on the said backing member by coating said abrasive grain continuing material on the backing member using a rotogravure roll.

18. Coated abrasive material according to claim 17 wherein the said rotagravure roll has a mexagonal-shaped pattern provided in its surface.

19. Coated abrasive material according to claim 18 wherein the hexagonal-shaped pattern is characterized by 80 hexagonal-shaped cells per inch.

20. Coated abrasive material suitable for use in fine finishing applications comprising:

(a) a backing member; and (b) a raised pattern on said backing member defined by a plurality of contiguous formations of a coated abrasive each said formation having a top edge and an inner bottom edge which define areas having no abrasive material and an inner wall of abrasive material connecting together said top and bottom edge, said abrasive coating comprising particles of abrasive grain dispersed in a radiation cured binder system, a coating of a suitable silane coupling agent being provided on said abrasive grain particles, said binder system binding said abrasive particles together and to the said backing member and comprising in combination as its major components a radiation cured mixture comprising a diacrylated epoxy oligomer of the bisphenol-a type, trimethylol propane triacrylate, hexane diol diacrylate, and N-vinyl-2-pyrrolidone.

21. Coated abrasive material according to claim 20 wherein the silane coupling agent has a double bond and is capable of copolymerizing with acrylic resins.

22. Coated abrasive material according to claim 21 wherein the silane coating agent is gamma-methacryloxypropyl trimethoxysilane.

23. Coated abrasive material according to claim 20 wherein the said abrasive grain is a high purity, virgin aluminum oxide which has been precision graded by air-classification, said abrasive grains being in a size range of from about 0.2 to about 12.0 microns, the triacrylated monomer is present in the binder formulation in an amount from about 25 to 40% by weight, the diacrylated monomer and diacrylated epoxy oligomer are present in amounts from about 10 to 20%, and from about 20 to 50% by weight, respectively, and the vinyl pyrrolidone is present in an amount of from about 01 to 20% by weight.

24. Coated abrasive material according to claim 23 wherein the mass ratio of abrasive grains to binder is from about 1.0 to about 3.0.

25. Coated abrasive material according to claim 24 wherein the backing member is a 5 mil polyester film.

26. Coated abrasive material according to claim 25 wherein the abrasive grains have been pretreated with a silane coupling agent prior to being dispersed in the binder system and said coupling agent is present on said abrasive grains in an amount from about 0.5% to about 5%, based upon the weight of the abrasive grains.

27. A process for the manufacture of a coated abrasive material suitable for use in lapping operations comprising:

(a) providing a dispersion of abrasive grain in a curable binder, said dispersion having non-Newtonian properties;

(b) depositing said dispersion on one side of a dimensionally stable backing member in a pattern of three-dimensional coated abrasive formations and a plurality of areas devoid of abrasive material; and (c) curing said binder to freeze said dispersion in said pattern.

28. The process as recited in claim 27 wherein said binder is a radiation curable binder and said step of curing said binder includes exposing said binder to actinic radiation.

29. The process as recited in claim 27 wherein said depositing step is performed by a gravure roll by rotating said gravure roll in a coating pan continuing said non-Newtonian dispersion, and by bringing said gravure roll into contact with the backing member for transferring said dispersion from the gravure roll to the backing member, the gravure roll being wiped with a doctor blade prior to contact with the backing member.

30. The process as recited in claim 27 wherein said depositing step is performed by a gravure roll having a plurality of depressions, said non-Newtonian dispersion having a viscosity high enough to produce a pattern reflecting the outlines of the depressions of said gravure roll.

31. Process for the manufacture of coated abrasive material according to claim 29 wherein the gravure roll used is characterized by a pattern of hexagonal-shaped cells provided in its peripheral surface, said pattern being defined by a multiplicity of rows extending lengthwise of the said gravure roll, each said row comprising a plurality of said hexagonal-shaped cells which are in alignment linear fashion with respect to one another.

32. Process for the manufacture of coated abrasive material according to claim 27 wherein the abrasive grain comprises aluminum oxide in the size range of from about 0.2 microns to 35 microns.

33. Process for the manufacture of coated abrasive material according to claim 28 wherein the radiation-curable binder comprises a mixture of an acrylated epoxy oligomer and a member selected from the group consisting of multifunctional acrylic monomers and a mono-functional radiation-curable monomer.

34. Process for the of coated abrasive material according to claim 28 wherein the abrasive grain is precision graded, virgin aluminum oxide in the size range of from about 0.5 to 5.0 microns, and the radiation-curable binder comprises a mixture of an oligomer of a diacrylated ester of epoxy resin of the bisphenol-A type, trimethylopropane triacrylate monomer, a hexanediol diacrylate monomer, and N-vinyl-2 pyrrolidone, and the viscosity of the said binder mixture is about 1750 cps when measured with a #2 spindle at 6 rpm, at 76° F. and about 3400 cps (spindle #2, at 30 rpm), indicating that the dispersion is characterized by non-Newtonian liquid flow characteristics.

35. Process for the manufacture of coated abrasive material according to claim 27 wherein the abrasive grain is pretreated with a solution comprising a silane coupling agent prior to being dispersed in the radiation-curable binder.

36. Process for the manufacture of coated abrasive material according to claim 27 wherein 80 hexagonal-shaped cells per inch are provided in the rotogravure roll, each having a depth of 0.0049 inches whereby the theoretical cell volume inch in cubic billion microns is $22.1 \times 10^9$.

37. Coated abrasive material suitable for use in lapping operations manufactured by the process according to claim 27.

38. Coated abrasive material suitable for use in an ophthalmic finishing machine in the second fining operation manufactured by the process according to claim 36.

39. Process for the manufacture of coated abrasive material suitable for use in fine finishing applications comprising the following steps:

(a) first providing particles of precision graded, high purity abrasive grain in a size range of from about 0.2 microns to about 35 microns;

(b) applying to said abrasive grain particles a solution comprising a silane coupling agent suitable for coupling abrasive grain to an organic binder dissolved in a water:alcohol solution;

(c) drying said silane coated abrasive grain particles and breaking up any agglomerates formed to provide suitable sized silane treated abrasive grain particles;

(d) admixing said silane treated abrasive grain particles with and dispersing said particles in a binder composition comprising as the essential components a diacrylated epoxy resin oligomer of the bisphenol-A type, a monomer of trimethylolpropane triacrylate, a monomer of hexanediol diacrylate, and vinyl pyrrolidone whereby to form a highly viscous, non-Newtonian liquid dispersion;

(e) providing a backing member of polyethylene terapthalate;

(f) applying said dispersion of binder and abrasive grain to said backing member with a rotogravure roll whereby to provide a pattern thereon defined by a plurality of contiguous coated abrasive formations each defined by a bottom and top edge defining areas devoid of coated abrasive and an inner wall connecting the two edges together; and (g) curing the binder in said dispersion by UV light.

40. Process for increasing adhesion between abrasive grains and a binder wherein the abrasive grains are dispersed in a liquid binder composition comprising a combination of radiation curable monomers having mono- and multi- acrylate functionality, said process comprising:

(a) admixing a silane coupling agent with an equal amount by weight of water;

(b) allowing said mixture to hydrolyze;

(c) mixing a desired amount of abrasive grain with said hydrolyzed silane coupling agent;

(d) allowing said mixture of grain and coupling agent to stand for several hours for conditioning; and (e) drying said silane treated grains at a temperature above 100° C. for several hours.

41. The coated abrasive as recited in claim 1 wherein said formations form geometrical patterns having central areas devoid of abrasive material.

42. The coated abrasive as recited in claim 41 wherein at least some of said formations have cross-sections which are substantially uniform along a length thereof.

43. The coated abrasive as recited in claim 1 wherein said abrasive material comprises abrasive grains disposed in a radiation curable binder.

44. The coated abrasive as recited in claim 1 wherein said abrasive material comprises a dispersion of abrasive grains in a curable binder having non-Newtonian properties prior to being cured.

45. The coated abrasive as recited in claim 1 wherein said formations define hexagonal patterns.

* * * * *

UNITED STATES PATENT AND TRADEMARK OFFICE

CERTIFICATE OF CORRECTION

PATENT NO. : 5,014,468

DATED : May 14, 1991

INVENTOR(S) : Ravipati et al

It is certified that error appears in the above-indentified patent and that said Letters Patent is hereby corrected as shown below:

Column 17, line 10

After "cells" insert ---are responsible for the particular pattern generated on the coating surface. It is thus possible that individual gravure cells---

Column 8, Line 56

After "the" insert ---teachings of commonly-owned U.S. Patent 4,543,107 to Rue.---

Column 26, Claim 23, Line 11

Delete "01" and insert ---10---

Column 26, Claim 26, Line 22

After Diameter delete "0.5%" and insert ---0.1%---

Signed and Sealed this

Thirteenth Day of September, 1994

*Attest:*

*Attesting Officer*

Bruce Lehman

BRUCE LEHMAN

*Commissioner of Patents and Trademarks*